US009050841B1

(12) United States Patent
Shih

(10) Patent No.: US 9,050,841 B1
(45) Date of Patent: Jun. 9, 2015

(54) PORTABLE STAMP WITH AN EASILY REMOVABLE INK PART

(71) Applicant: SUN SAME ENTERPRISES CO., LTD., Tainan (TW)

(72) Inventor: Wen-Jer Shih, Tainan (TW)

(73) Assignee: SUN SAME ENTERPRISES CO., LTD., Tainan (TW)

( * ) Notice: Subject to any disclaimer, the term of this patent is extended or adjusted under 35 U.S.C. 154(b) by 0 days.

(21) Appl. No.: 14/148,525

(22) Filed: Jan. 6, 2014

(51) Int. Cl.
*B41K 1/00* (2006.01)
*B41K 1/38* (2006.01)
*B41K 1/54* (2006.01)

(52) U.S. Cl.
CPC ..... *B41K 1/54* (2013.01)

(58) Field of Classification Search
CPC ..... B41K 1/00; B41K 1/38; B41K 1/54
USPC ..... 101/101, 103, 108, 125, 127, 327, 333, 101/368, 406
See application file for complete search history.

(56) References Cited

U.S. PATENT DOCUMENTS

| | | | | | |
|---|---|---|---|---|---|
| 3,020,838 | A * | 2/1962 | Prost | ..... | 101/333 |
| 4,676,162 | A * | 6/1987 | Phipps et al. | ..... | 101/405 |
| 5,505,130 | A * | 4/1996 | Winston | ..... | 101/333 |
| 6,199,482 | B1 * | 3/2001 | Yasoshima | ..... | 101/333 |
| 2010/0031835 | A1 * | 2/2010 | Faber | ..... | 101/333 |

FOREIGN PATENT DOCUMENTS

| | | | | | |
|---|---|---|---|---|---|
| GB | 242197 | A * | 6/1925 | ..... | B41F 17/30 |
| JP | 11034453 | A * | 2/1999 | ..... | B41K 1/02 |
| JP | 2000168214 | A * | 6/2000 | ..... | B41K 1/54 |

* cited by examiner

*Primary Examiner* — Nguyen Ha
(74) *Attorney, Agent, or Firm* — WPAT, P.C.; Anthony King

(57) ABSTRACT

A portable stamp has a stamp box, an ink part and a stamping part. The stamp box has a first case and a second case pivotally connected to the first case. The ink part and the stamping part are mounted in the first case and the second case respectively. The first case has a peripheral wall and a positioning hole formed through the peripheral wall. The ink part is mounted in the peripheral wall and has a positioning plate mounted through the positioning hole. The ink part is located in the first case by the positioning plate. When replacing a dry ink part with a new one, a user just presses the positioning plate to loosen the dry ink part from the first case. Then the user can remove the dry ink part easily and mount the new ink part in the first case.

6 Claims, 7 Drawing Sheets

PORTABLE STAMP WITH AN EASILY REMOVABLE INK PART

BACKGROUND OF THE INVENTION

1. Field of the Invention

The present invention relates to a stamp and more particularly to a portable stamp with an easily removable ink part.

2. Description of Related Art

A conventional portable stamp has a stamp box, an ink part and a stamping part. The stamp box has a bottom case and a cover case pivotally connected to the bottom case. The ink part and the stamping part are respectively mounted in the bottom case and the cover case. Thus, when the stamp box is closed, the stamping part contacts the ink part and stains with ink of the ink part. When the stamp box is open, a user can hold the cover case and use the stamping part to stamp on documents.

When the ink part is out of ink, the user has to replace the ink part with a new ink part, that is, the user has to remove the dry ink part, and then mount the new ink part in the bottom case. However, the ink part is mounted in the bottom case with an edge of the ink part tightly abutting an inner wall of the bottom case, such that it is difficult for the user to remove the ink part from the bottom case, and hands of the user are usually stained with ink while replacing the ink part.

SUMMARY OF THE INVENTION

The main objective of the invention is to provide a portable stamp with an easily removable ink part.

The portable stamp comprises a stamp box, an ink part and a stamping part. The stamp box has a first case, a second case and a buckle part. The first case has two opposite sides, a peripheral wall, a first accommodating space and a positioning hole, wherein the first accommodating space is formed within the peripheral wall, and the positioning hole is formed through the peripheral wall. The second case has two opposite sides, wherein one of the two sides of the second case is pivotally connected to one of the two sides of the first case. The buckle part is mounted between the other side of the first case and the other side of the second case, wherein the first case and the second case are selectively connected by the buckle part. The ink part is mounted in the first accommodating space of the first case, and has an ink base and an ink layer. The ink base has a base body and a positioning plate formed on a side of the base body, wherein the positioning plate is mounted through the positioning hole and extends out of the peripheral wall. The ink layer is mounted in the base body. The stamping part is mounted in the second case, and has a stamping sheet. The stamping sheet has a stamping surface extending out of the second case, wherein when the first case and the second case are connected by the buckle part, the stamping surface contacts the ink layer of the ink part.

The ink part of the portable stamp in accordance with the present invention is mounted in the first case by the positioning plate mounted through the positioning hole. When a user wants to remove the ink part from the first case, the user can just press the positioning plate horizontally from the outside of the first case to loosen the ink part from the first case, and then press the positioning plate upward to make a side of the base body tilt out of the first case, such that the user can hold the base body to remove the ink part from the first case without contacting the ink layer. In conclusion, the ink part of the portable stamp in accordance with the present invention is easy to remove from the first case by the positioning plate, and the user can avoid contacting the ink layer, such that the user can keep hands clean during replacement of the ink layer.

DETAILED DESCRIPTION OF THE PREFERRED EMBODIMENTS

Figure 1:
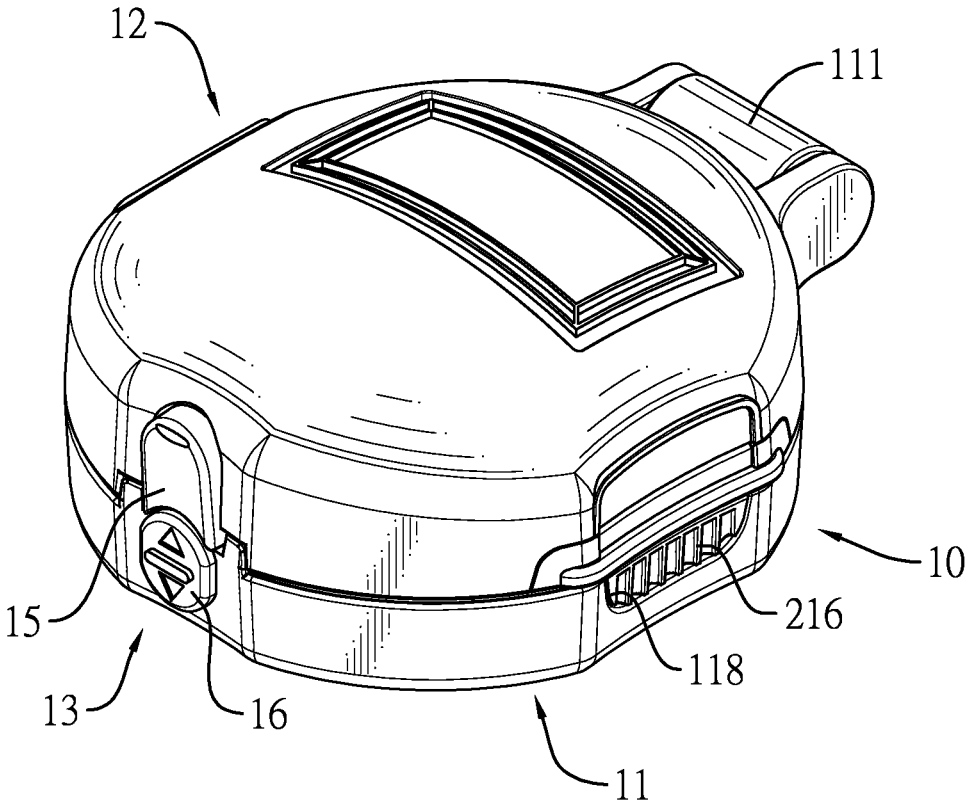
FIG. 1 is a perspective view of a preferred embodiment of a portable stamp in accordance with the present invention showing the portable stamp closed.
Figure 2:
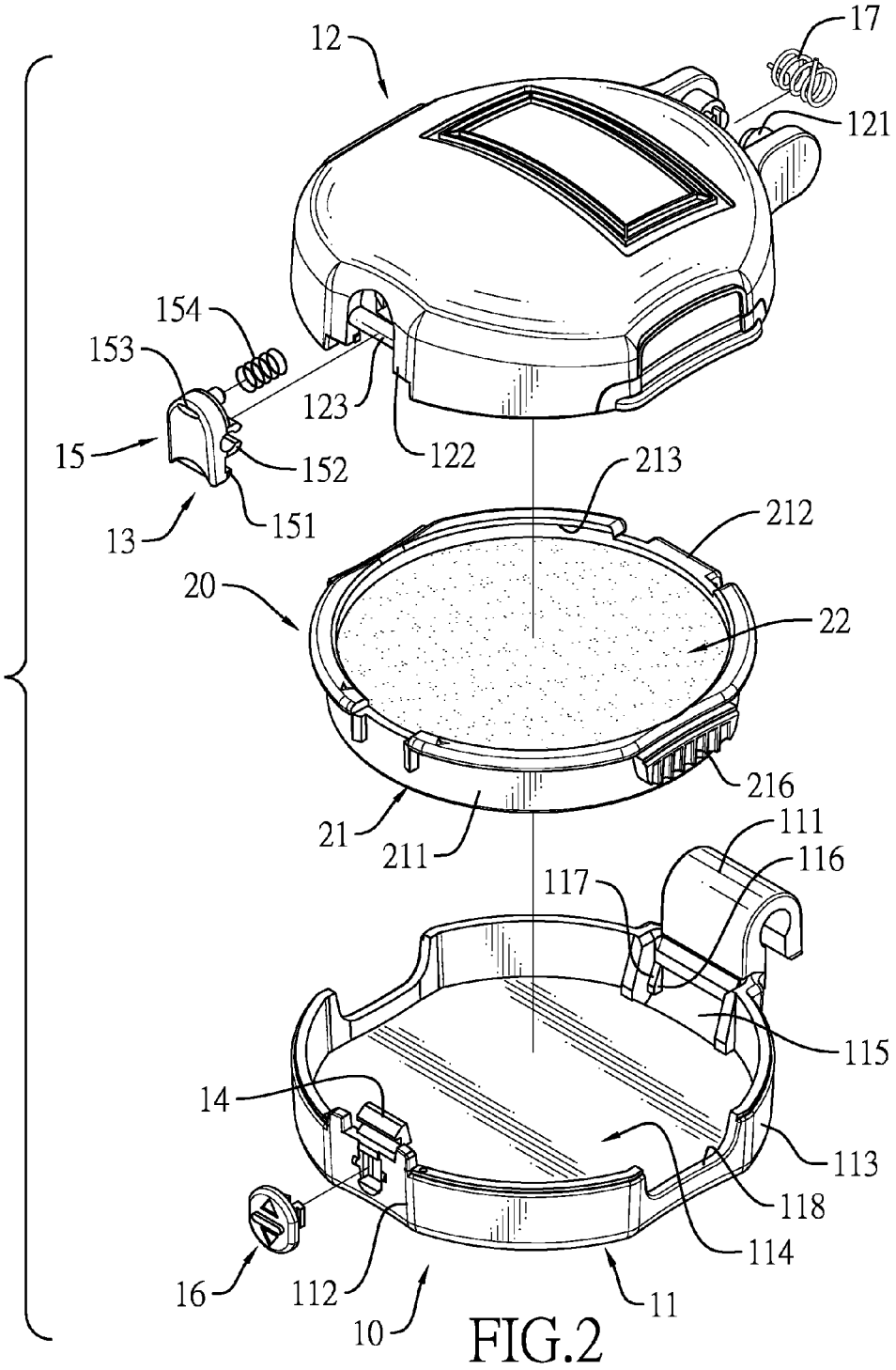
FIG. 2 is an exploded view of the portable stamp in FIG. 1.
Figure 4:
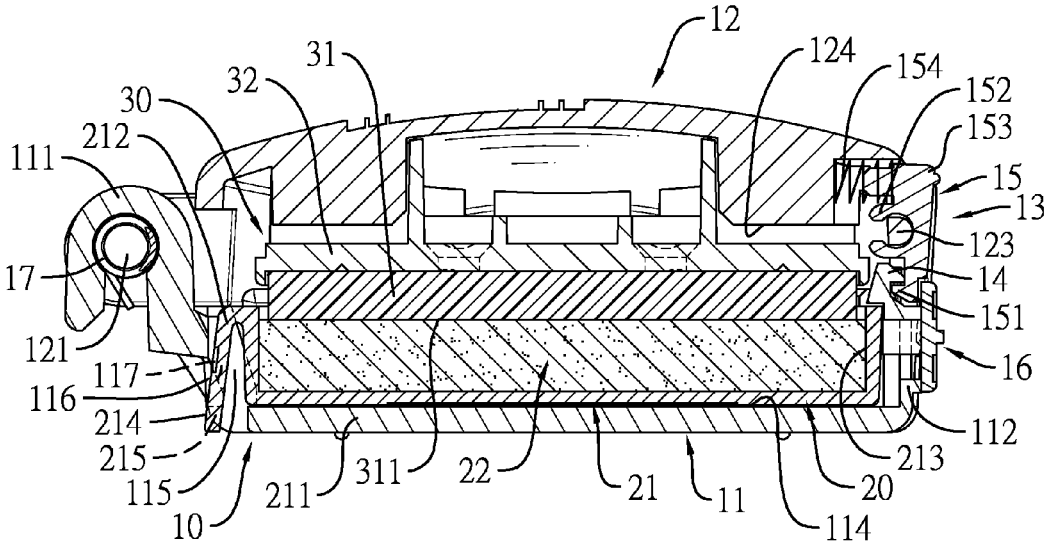
FIG. 4 is a side view in cross section of the portable stamp in FIG. 1 showing the portable stamp closed.

With reference to FIGS. 1, 2 and 4, a preferred embodiment of a portable stamp in accordance with the present invention comprises a stamp box 10, an ink part 20 and a stamping part 30.

The stamp box 10 has a first case 11, a second case 12 and a buckle part 13.

The first case 11 has two opposite sides, a first pivoting part 111, a first connecting part 112, a peripheral wall 113, a first accommodating space 114 and a positioning hole 115. The first pivoting part 111 and the first connecting part 112 are mounted respectively on the two opposite sides of the first case 11. The first accommodating space 114 is formed within the peripheral wall 113. The positioning hole 115 is formed through the peripheral wall 113, wherein the ink part 20 is mounted in the first accommodating space 114.

The second case 12 has two opposite sides, a second pivoting part 121, a second connecting part 122 and a second accommodating space 124. The second pivoting part 121 and the second connecting part 122 are mounted respectively on the two opposite sides of the second case 12. The second case 12 is pivotally connected to the first case 11 via pivotally connecting the second pivoting part 121 to the first pivoting part 111 of the first case 11. The second accommodating space 124 corresponds in position to the first accommodating space 114. When the stamp box 10 is closed, the second accommodating space 124 faces the first accommodating space 114. The stamping part 30 is mounted in the second accommodating space 124.

The buckle part 13 is mounted between the first connecting part 112 and the second connecting part 122. When the buckle part 13 is fastened, the first case 11 and the second case 12 are connected by the buckle part 13, such that the stamp box 10 is closed. When the buckle part 13 is unfastened, the second case 12 is able to rotate to open the stamp box 10.

With reference to FIGS. 1 to 4, in the preferred embodiment, the first pivoting part 111 of the first case 11 is a pivoting cover having a pivoting groove, and the second pivoting part 121 of the second case 12 is a pivoting rod. The second pivoting part 121 is mounted in the pivoting groove of the first pivoting part 111. Furthermore, the stamp box 10 further comprises a torque spring 17 mounted around and on the second pivoting part 121 and mounted in the pivoting groove of the first pivoting part 111. The torque spring 17 has two abutting ends adjacent to the first pivoting part 111 and the second pivoting part 121 respectively. When the stamp box 10 is closed by the buckle part 13, the torque spring 17 stores kinetic energy. When the buckle part 13 is unfastened, the torque spring 17 releases the stored kinetic energy to open the stamp box 10 immediately.

With reference to FIGS. 1 to 4, in the preferred embodiment, the buckle part 13 includes a barb hook 14 and a buckle hook 15. The barb hook 14 is mounted on the first connecting part 112 of the first case 11, and the buckle hook 15 is mounted on the second connecting part 122 of the second case 12. When the buckle hook 15 is buckled on the barb hook 14, the stamp box 10 is closed. When the buckle hook 15 is unfastened from the barb hook 14, the stamp box 10 can be opened.

With reference to FIGS. 1 to 4, in the preferred embodiment, the first connecting part 112 is formed on the peripheral wall 113 of the first case 11, and the barb hook 14 is formed on the first connecting part 112. The second case 12 further has a pivoting rod 123 and an inner wall distal from the pivoting rod 123, wherein the pivoting rod 123 is formed on the second connecting part 122. The buckle hook 15 has two opposite ends, a hook part 151, a pivoting cover 152, a pressing part 153 and a compression spring 154. The hook part 151 is formed on one of the ends of the buckle hook 15 that is adjacent to the barb hook 14, such that the hook part 151 can be hooked on the barb hook 14 to close the stamp box 10. The pivoting cover 152 is formed on the buckle hook 15 and between the two opposite ends of the buckle hook 15, wherein the pivoting cover 152 is sleeved on and pivotally connected to the pivoting rod 123. The pressing part 153 is mounted on the other end of the buckle hook 15 that is distal from the barb hook 14, and the compression spring 154 is mounted on the buckle hook 15 and faces the inner wall of the second case 12, thus, the compression spring 154 sustains the pressing part 153 by an elasticity of the compression spring 154.

With reference to FIGS. 1 to 4, in the preferred embodiment, the buckle part 13 further has a movable buckle 16 movably mounted on the first connecting part 112 of the first case 11, wherein the movable buckle 16 can buckle the buckle hook 15 to further provide a double buckle function for the stamp box 10.

Figure 3:
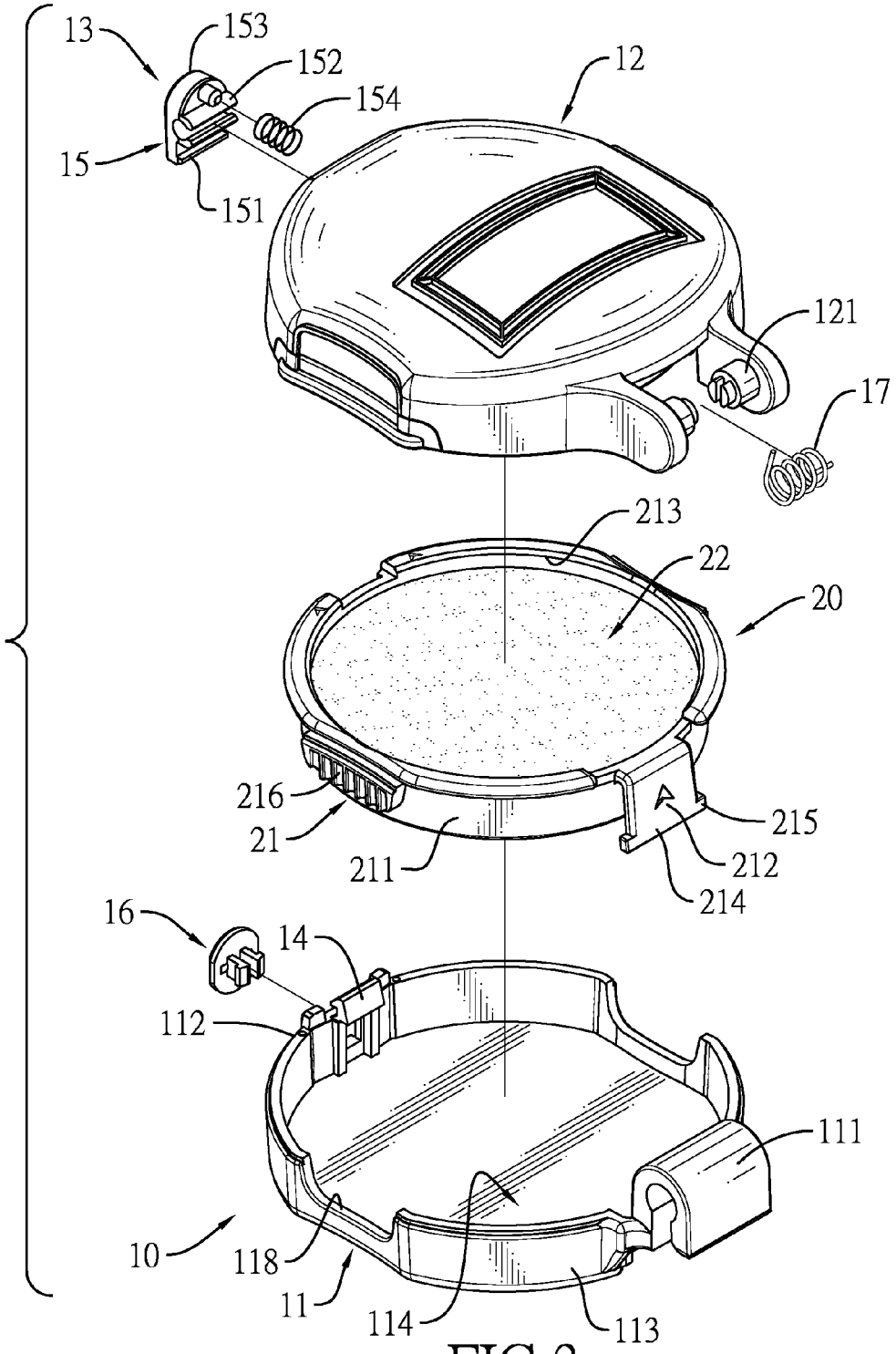
FIG. 3 is another exploded view of the portable stamp in FIG. 1.

With reference to FIGS. 2 to 4, the ink part 20 is mounted in the first accommodating space 114 of the first case 11, and has an ink base 21 and an ink layer 22. The ink base 21 has a base body 211, a positioning plate 212 and an ink accommodating space 213. The ink accommodating space 213 is formed concave on the base body 211, wherein the ink layer 22 is mounted in the ink accommodating space 213. The positioning plate 212 is formed on a side of the base body 211, wherein the positioning plate 212 is mounted through the positioning hole 115 and extends out of the peripheral wall 113 to locate the ink part 20 in the first accommodating space 114.

With reference to FIGS. 2 and 4, in the preferred embodiment, the first case 11 of the stamp box 10 further has two opposite positioning blocks 116 mounted in an inner edge of the positioning hole 115. The ink part 20 further has two positioning bumps 215, and the positioning plate 212 has a free end 214 having two opposite sides. The two positioning bumps 215 are formed on the two opposite sides of the free end 214 respectively, wherein the two positioning bumps 215 correspond in position to the two positioning blocks 116 respectively. Therefore, when the positioning plate 212 is mounted through the positioning hole 115, the two positioning bumps 215 abut the two positioning blocks 116 respectively to fasten the ink part 20. When the pressing part 153 is pressed, the two positioning bumps 215 depart from the two positioning blocks 116, thus, the ink part 20 can be removed from the first case 11.

With reference to FIGS. 2 and 4, in the preferred embodiment, each positioning block 116 has a bevel face 117 formed on a side of said positioning block 116 facing the first accommodating space 114. When the positioning plate 212 is mounted through the positioning hole 115, the two positioning bumps 215 abut the two bevel faces 117 of the two positioning blocks 116 respectively. The free end 214 of the positioning plate 212 is gradually curved toward the base body 211 of the ink base 21 until the two positioning bumps 215 depart from the two bevel faces 117 of the two positioning blocks 116. When the two positioning bumps 215 depart from the two bevel faces 117 of the two positioning blocks 116, the free end 214 returns to an original state and the two positioning bumps 215 abut the two positioning blocks 116 so that the positioning plate 212 is fixed at the positioning hole 115.

With reference to FIGS. 1 to 3, in the preferred embodiment, the base body 211 of the ink base 21 has two opposite sides, and the ink base 21 further has two holding parts 216 mounted on the two opposite sides of the base body 211. Each holding part 216 has a rugged surface facing toward outside of the first case 11 to prevent slipping. The first case 11 further has two opposite loading notches 118 formed on the peripheral wall 113 and corresponding in position to the two holding parts 216 of the ink base 21. The two holding parts 216 are mounted respectively in the two loading notches 118 and extend out of the first case 11. The user can hold the base body 211 easily via the two holding parts 216 to remove the ink part 20 from the first case 11.

With reference to FIG. 4, the stamping part 30 is mounted in the second accommodating space 124 of the second case 12, and has a stamping sheet 31. The stamping sheet 31 has a stamping surface 311 extending out of the second case 12, wherein when the first case 11 and the second case 12 are connected by the buckle part 13, the stamping surface 311 contacts the ink layer 22 of the ink part 20 to absorb ink.

With reference to FIG. 4, in the preferred embodiment, the stamping part 30 further has a stamping base 32 mounted in the second accommodating space 124 and having a fixing side, wherein the stamping sheet 31 is mounted on the stamping base 32. The stamping part 30 can be mounted in the second case 12 selectively via the stamping base 32.

With reference to FIG. 4, when a user carries the portable stamp in accordance with the present invention, the stamp box 10 is closed. The ink part 20 and the stamping part 30 are both stored in the stamp box 10, such that hands or clothes of the user would not be stained by the ink part 20 or the stamping part 30.

Figure 5:
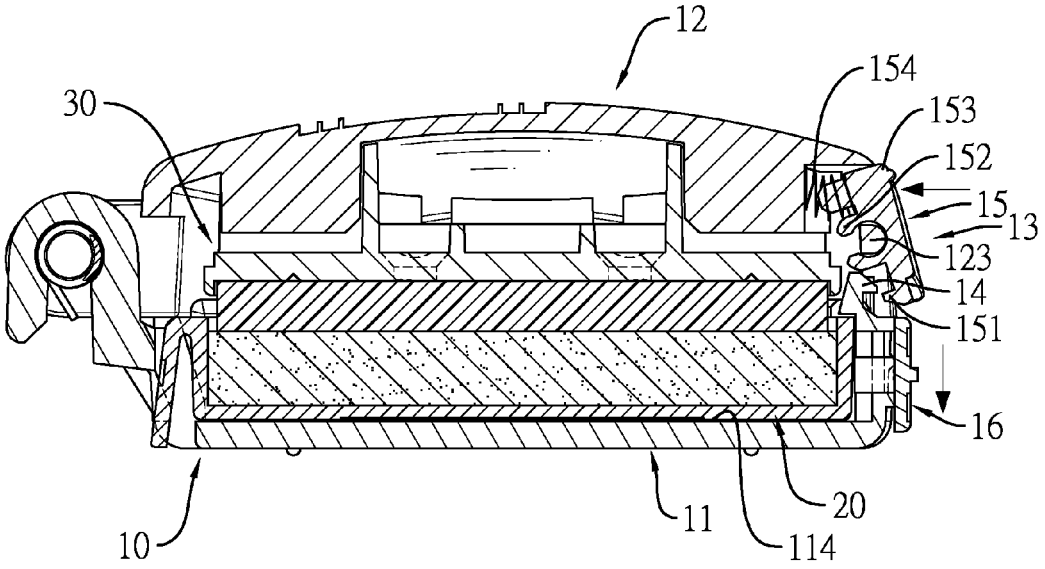
FIG. 5 is a side view in cross section of the portable stamp in FIG. 1 showing a movable buckle of a buckle part of the portable stamp shifting downward, and a buckle hook of the buckle part of the portable stamp pressed.
Figure 6:
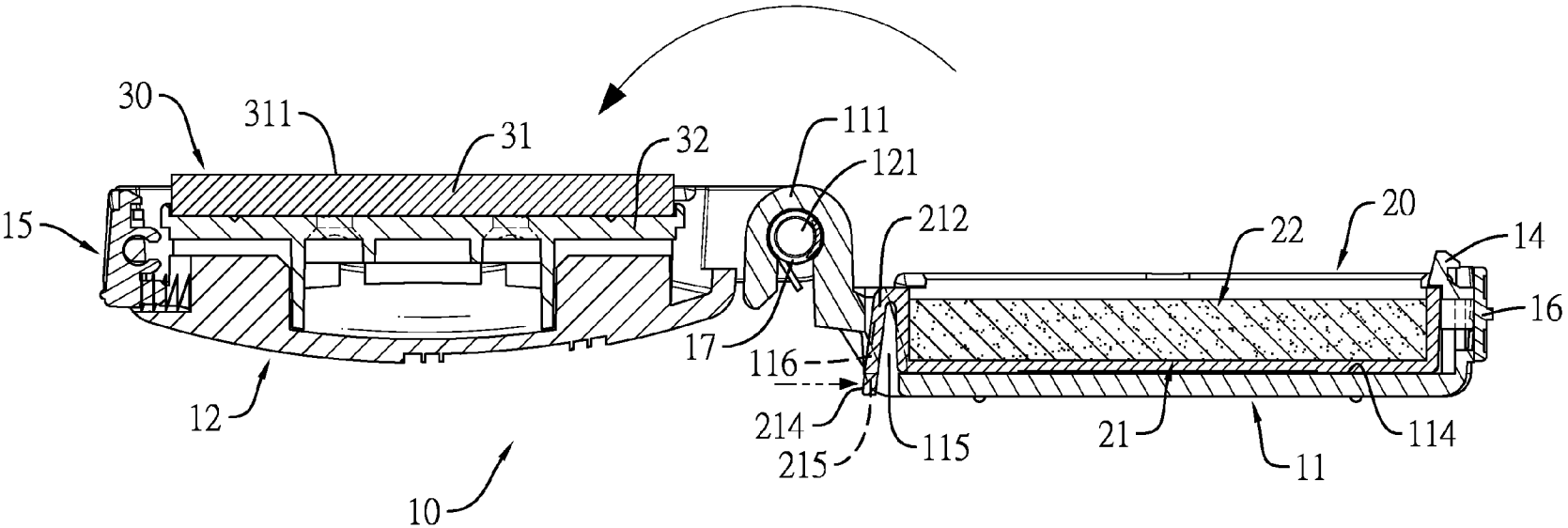
FIG. 6 is a side view in cross section of the portable stamp in FIG. 1 showing the portable stamp open, and a free end of a positioning plate of an ink part of the portable stamp pressed and detached from a positioning block of a first case of the portable seal.

With reference to FIGS. 5 and 6, when the user wants to use the portable stamp in accordance with the present invention, the user can unfasten the buckle part 13 and then rotate the second case 12 to open the stamp box 10. In the preferred embodiment, when the fastened buckle part 13 is unfastened, the movable buckle 16 is pressed to release the buckle hook 15. Then, the pressing part 153 is pressed and the compression spring 154 is compressed to rotate the buckle hook 15. When the hook part 151 of the buckle hook 15 departs from the barb hook 14 of the first case 11, the stamp box 10 is opened by the elastic force of the torque spring 17. The user can hold the second case 12 having the stamping part 30 to stamp on documents by the stamping surface 311 of the stamping part 30.

Figure 7:
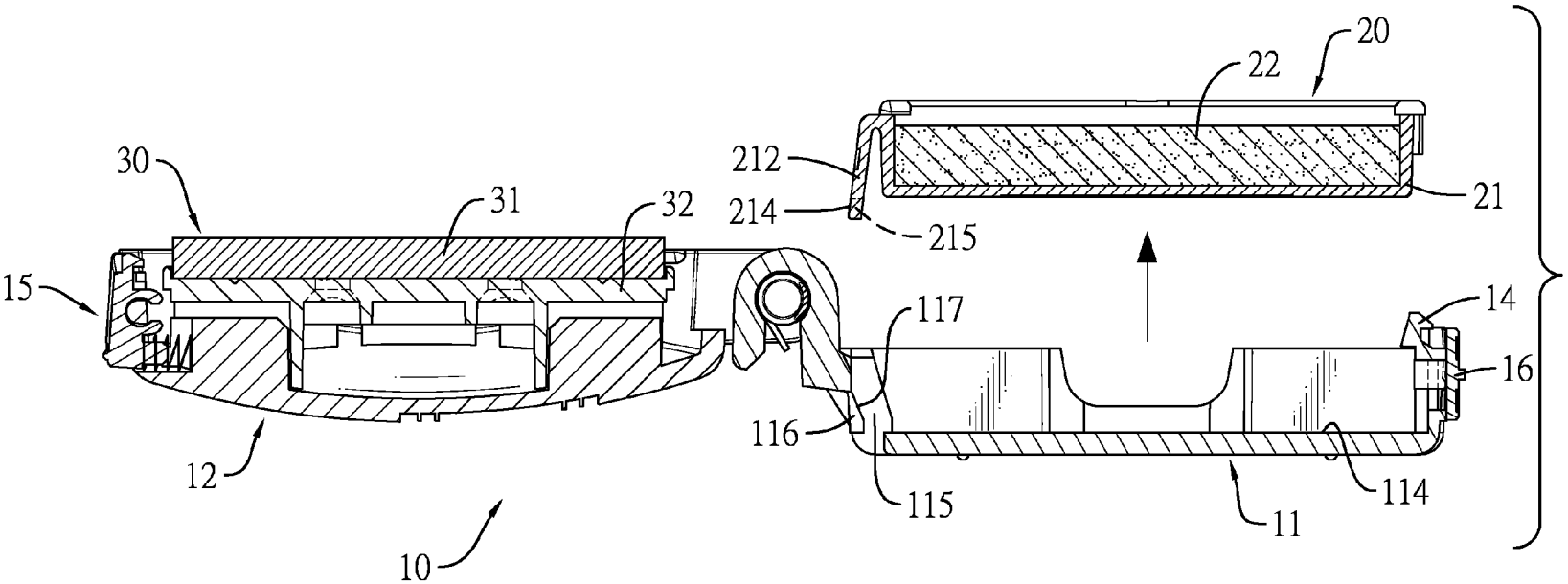
FIG. 7 is a side view of the portable stamp in FIG. 1 showing the portable stamp open, and the ink part removed from the first case.

With reference to FIGS. 6 and 7, when the user wants to replace a dry ink part 20 with a new one, the user can open the stamp box 10, and press the positioning plate 212 to make the two positioning bumps 215 depart from the two positioning blocks 116. Then the dry ink part 20 is loosened and can be removed from the first case 11. After that, the user can mount the new ink part 20 in the first case 11. The positioning plate 212 of the new ink part 20 is mounted through the positioning hole 115, and the two positioning bumps 215 of said positioning plate 212 abut the two positioning blocks 116 to locate the new ink part 20, such that the replacement of the ink part 20 of the preferred embodiment of the portable stamp in accordance with the present invention is completed.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A portable stamp with an easily removable ink part comprising:

a stamp box having a first case having two opposite sides;

a peripheral wall;

a first accommodating space formed within the peripheral wall; and a positioning hole formed through the peripheral wall;

a second case having two opposite sides, wherein one of the two sides of the second case is pivotally connected to one of the two sides of the first case; and a buckle part mounted between the other side of the first case and the other side of the second case, wherein the first case and the second case are selectively connected by the buckle part;

an ink part mounted in the first accommodating space of the first case and having an ink base having a base body having two opposite sides;

a positioning plate formed on the base body, wherein the positioning plate is mounted through the positioning hole and extends out of the peripheral wall; and two holding parts mounted on the two opposite sides of the base body; and an ink layer mounted in the base body; and a stamping part mounted in the second case and having a stamping sheet; and a stamping surface formed on the stamping sheet and extending out of the second case;

wherein when the first case and the second case are connected by the buckle part, the stamping surface contacts the ink layer of the ink part, the first base further has two opposite loading notches formed on the peripheral wall of the first base and corresponding in position to the two holding parts of the ink base, and the two holding parts are mounted in the two loading notches respectively and extend out of the first case.

2. The portable stamp with the easily removable ink part as claimed in claim 1, wherein the first case of the stamp box further comprises two opposite positioning blocks mounted in an inner edge of the positioning hole; and the positioning plate of the ink part further has a free end having two opposite sides; and two positioning bumps formed on the two opposite sides of the free end respectively and corresponding in position to the two positioning blocks of the first case;

wherein the two positioning bumps abut the two positioning blocks respectively to locate the ink part in the first case; when the positioning plate is pressed, the two positioning bumps depart from the two positioning blocks, and the ink part is loosened from the first case.

3. The portable stamp with the easily removable ink part as claimed in claim 2, wherein each positioning block of the first case has a bevel face formed on a side of said positioning block facing the first accommodating space.

4. The portable stamp with the easily removable ink part as claimed in claim 1, wherein each holding part has a rugged surface facing toward outside of the first case.

5. The portable stamp with the easily removable ink part as claimed in claim 2, wherein each holding part has a rugged surface facing toward outside of the first case.

6. The portable stamp with the easily removable ink part as claimed in claim 3, wherein each holding part has a rugged surface facing toward outside of the first case.

* * * * *